US007357063B2

(12) United States Patent
Balbo

(10) Patent No.: US 7,357,063 B2
(45) Date of Patent: Apr. 15, 2008

(54) WEAPON SYSTEM ABLE TO EQUIP A LIGHT VEHICLE AND PROCESS TO IMPLEMENT SUCH A WEAPON SYSTEM

(75) Inventor: Patrick Balbo, Bourges (FR)

(73) Assignee: Giat Industries, Versailles (FR)

( * ) Notice: Subject to any disclaimer, the term of this patent is extended or adjusted under 35 U.S.C. 154(b) by 123 days.

(21) Appl. No.: 11/302,132

(22) Filed: Dec. 14, 2005

(65) Prior Publication Data

US 2008/0053301 A1 Mar. 6, 2008

(30) Foreign Application Priority Data

Dec. 28, 2004 (FR) ..... 04 13966

(51) Int. Cl.
*F41A 23/34* (2006.01)
*F41A 23/46* (2006.01)

(52) U.S. Cl. ..... 89/40.04; 89/40.01

(58) Field of Classification Search ..... 89/40.01, 89/40.03, 40.04, 40.09; 212/302–305; 180/8.3–8.5; 280/763.1, 764.1, 765.1, 766.1; 188/7
See application file for complete search history.

(56) References Cited

U.S. PATENT DOCUMENTS

| | | | | |
|---|---|---|---|---|
| 1,040,520 | A * | 10/1912 | Davis | 188/7 |
| 1,951,338 | A * | 3/1934 | Barnes | 89/40.11 |
| 2,549,835 | A * | 4/1951 | McCann et al. | 89/40.11 |
| 2,781,927 | A * | 2/1957 | Holopainen | 414/694 |
| 3,113,641 | A * | 12/1963 | Metailler | 188/7 |
| 4,369,989 | A * | 1/1983 | Mankey | 280/764.1 |
| 4,536,009 | A * | 8/1985 | Ashworth | 280/755 |
| 4,569,422 | A * | 2/1986 | Hoffman | 188/7 |
| 4,648,780 | A * | 3/1987 | Harms et al. | 414/686 |
| 6,000,313 | A | 12/1999 | Becker et al. | |
| 6,021,860 | A * | 2/2000 | Jones | 180/8.4 |
| 6,092,975 | A * | 7/2000 | Cannon et al. | 414/563 |
| 6,161,639 | A * | 12/2000 | Jones | 180/8.4 |
| 6,227,569 | B1 * | 5/2001 | Dingeldein et al. | 280/764.1 |
| 6,843,159 | B2 * | 1/2005 | Pek et al. | 89/40.11 |
| 2002/0129696 | A1 * | 9/2002 | Pek et al. | 89/40.01 |

FOREIGN PATENT DOCUMENTS

| | | |
|---|---|---|
| DE | 1 962 766 | 3/1971 |
| EP | 0 663 583 A1 | 11/1994 |
| GB | 03972 | 0/1916 |

OTHER PUBLICATIONS

Biass E. J., et al., "Self-Propolled Artillery Autoloading and 52 are the Trend," *Armada International* vol. 27, No. 4 2003 p. 43-64 (2003).

. . . , "TM9-1015-221-34P Technical Manual Direct Support and General Support and General Support Maintenance Repair Parts and Special Tools List for Rifle, Recoilles, 106-MM:M40A2 (1015-00-133-8484) and M40A4 (1015-00-133-8485)" *Department of the Army* (1986).

* cited by examiner

*Primary Examiner*—Bret Hayes
(74) *Attorney, Agent, or Firm*—Steptoe & Johnson LLP

(57) ABSTRACT

The invention relates to a weapon system incorporating a cannon mounted on a cradle integral with a vehicle, characterized in that the cradle is integral with a base fastened at the rear part of the vehicle, base on which at least two arms are hinged each carrying a spade at their ends, each arm able to be locked into its extended position and also incorporating a safety support intended to press on the ground between the spade and the base.

12 Claims, 8 Drawing Sheets

WEAPON SYSTEM ABLE TO EQUIP A LIGHT VEHICLE AND PROCESS TO IMPLEMENT SUCH A WEAPON SYSTEM

CLAIM OF PRIORITY

This application claims priority under 35 USC 119 to French Patent Application No. 4.13966, filed on Dec. 28, 2004, the entire contents of which is hereby incorporated by reference.

BACKGROUND OF THE INVENTION

1. Field of the Invention

The technical scope of the invention is that of weapon systems and namely weapon systems mounted on a vehicle.

2. Description of the Prior Art

It is well known to associate a weapon system with a vehicle. However, specific vehicles are generally implemented, which have been designed to be able to carry the weapon system in question and which are namely able to withstand the firing stresses.

Thus, heavy or light armored vehicles, wheeled or tracked, and provided with a turret fitted with a cannon whose caliber may be between 75 mm and 155 mm are known.

155 mm field artillery systems are also known which are mounted onto strengthened trucks from which they are able to fire thanks to the implementation of stabilizers or rear spades able to take up the firing stresses. These pieces of artillery have the advantage of being very mobile but the vehicle used has been modified and strengthened to enable the weapon to be fired.

Known systems are also relatively heavy (at least 18 tons) and their sheer bulk limits the possibilities of air transportation into theatres of operation.

To endow the armed forces with improved mobility and firing power, it would be advantageous to equip light, very mobile vehicles (mass of less than 5 tons) with artillery. However, at present such vehicles are not able to withstand the stresses generated by an artillery firing.

SUMMARY OF THE INVENTION

The aim of the invention is to propose a weapon system able to equip a light vehicle (mass of less than 5 tons) whilst reducing to an acceptable level the stresses to which such vehicle would be subjected. The weapon system according to the invention can also be very quickly implemented and it enables the firing power and mobility of land forces to be improved.

Thus, the invention relates to a weapon system incorporating a cannon mounted on a cradle integral with a vehicle, weapon system wherein the cradle is integral with a base fastened at the rear part of the vehicle, base on which at least two arms are hinged each carrying a spade at their ends, each arm able to be locked into its extended position and also incorporating a safety support intended to press on the ground between the spade and the base.

In a preferred manner, each safety support has a plate at its foot that presses on the ground, such plate being hinged to the support.

Advantageously, when the arm is in the extended position and when the vehicle is on horizontal ground, the safety support is substantially vertical and the end of the spade is at a distance from the ground of between 0 mm and 200 mm.

The distance between the safety support and the articulation point of the arm on the base will preferably be between 5% and 20% of the full length of the support.

The base may incorporate at least two branches onto which the arms are hinged, locking means being provided between each branch and the articulated arm that it carries.

The locking means will advantageously be in the locking position when the arm is inclined with respect to the horizontal by an angle of between 10° and 30°.

The base may carry a turntable onto which a fork carrying the cradle is fastened.

The cannon cradle may be pivoted in elevation and in traverse with respect to the base using motor means.

The arms may be made to pivot by hydraulic jacks powered by a generator integral with the vehicle.

The cannon may be of a caliber of between 75 mm and 155 mm and the pivoting capacity of the cradle in traverse may be over 100°.

The pivoting capacity in elevation may be of between −10° and +70°.

The invention also relates to a process to implement such a weapon system, such process wherein to set up the weapon system, the following steps are carried out successively:

- the arms are extended rearwards of the vehicle until the safety supports come to rest on the ground,
- the vehicle is made to reverse so as to make the arms pivot on the ends of the safety supports pushing the spades into the ground.

To withdraw the weapon system, the following steps are carried out successively:

- the arms are unlocked,
- the vehicle is driven forward to pull the spades from the ground,
- the arms are folded to the front of the vehicle.

BRIEF DESCRIPTION OF THE DRAWINGS

The invention will become more apparent from the following description of a particular embodiment, such description made in reference to the appended drawings, in which.

BRIEF DESCRIPTION OF PREFERRED EMBODIMENTS

Figure 1:
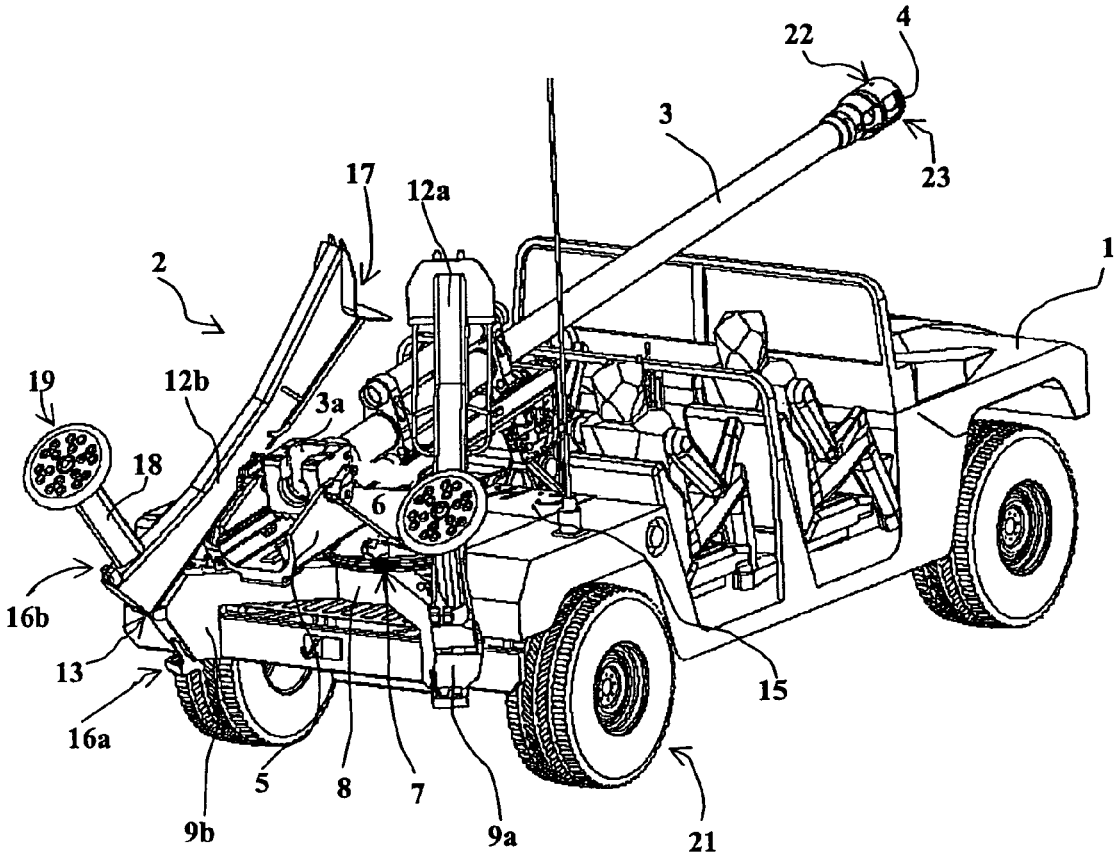
FIG. 1 shows a rear perspective view of a vehicle equipped with a weapon system according to the invention, the weapon system being in its transport position.

FIG. 1 shows a rear perspective view of a vehicle 1 equipped with a weapon system 2 according to the invention.

The vehicle is a light vehicle (mass less than 5 tons), and here it is a 4×4 HMMWV (American Motors registered trademark) whose rear has been emptied out to receive the weapon system.

The weapon system 2 incorporates a canon 3 equipped with muzzle brake 4, such cannon mounted on a cradle 5.

Figure 2A:
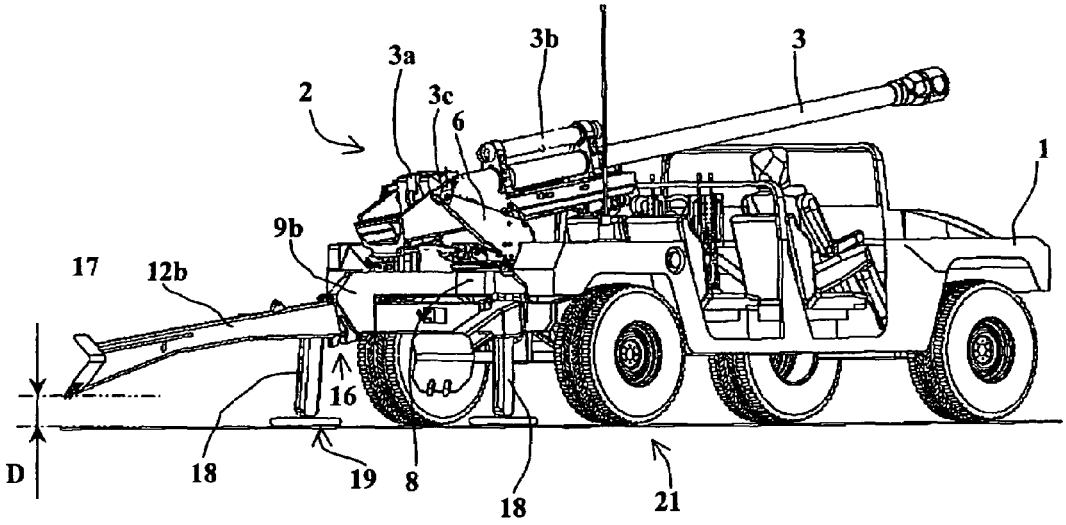
FIGS. 2*a*, 2*b* and 2*c* show three success steps in the deployment and implementation of the weapon system according to the invention, FIGS. 3*a*, 3*b* and 3*c* partially show the deployed weapon along three viewing axes.
Figure 2B:
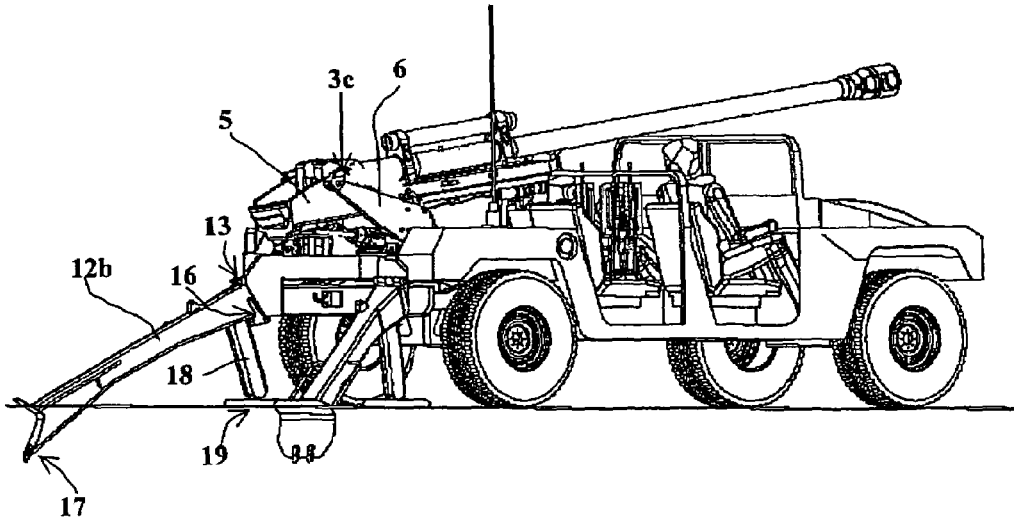
Figure 2C:
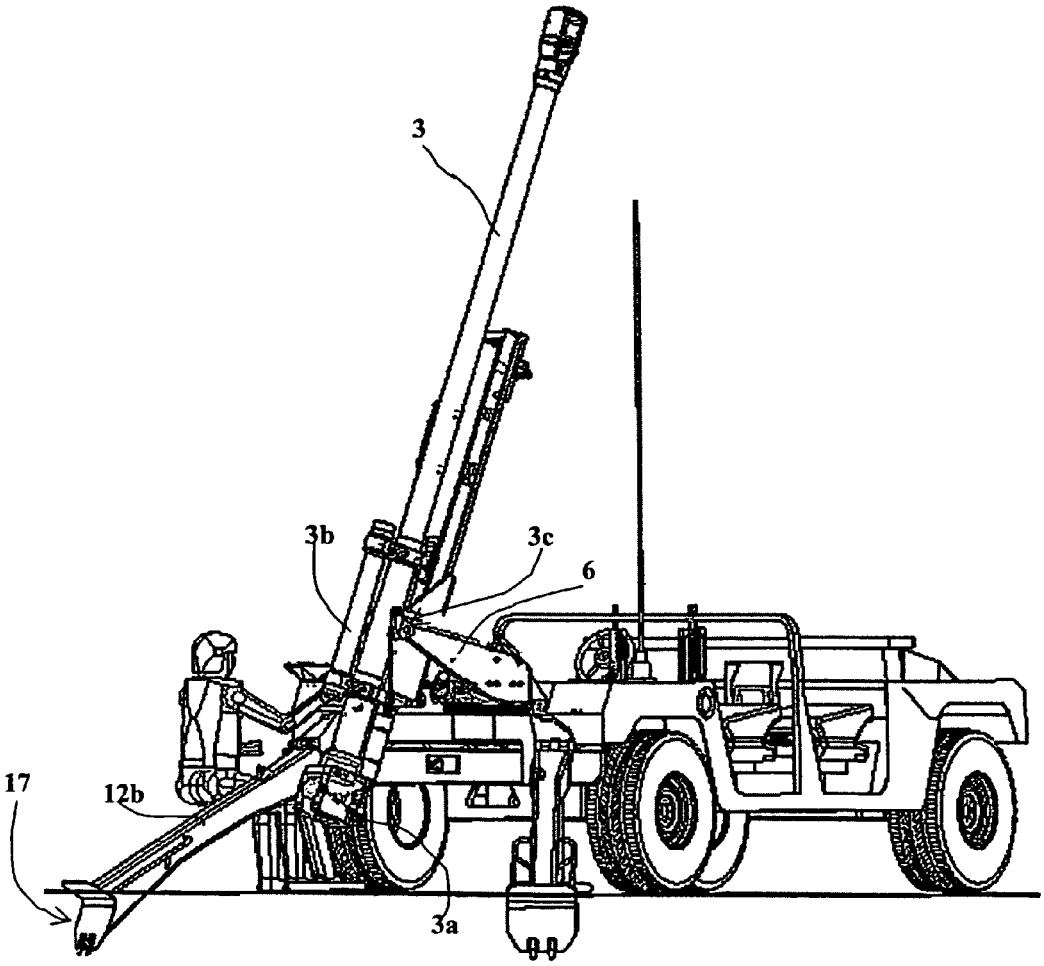

The structure of the cannon is not the subject of the resent invention. The cannon classically comprises a breech ring 3*a* and a hydraulic recoil brake 3*b* connecting the cannon to the cradle (see FIG. 2*c*).

The cradle 5 is mounted able to pivot around a shaft 3*c* on a fork 6, thereby enabling the weapon to be laid in elevation.

Figure 3A:
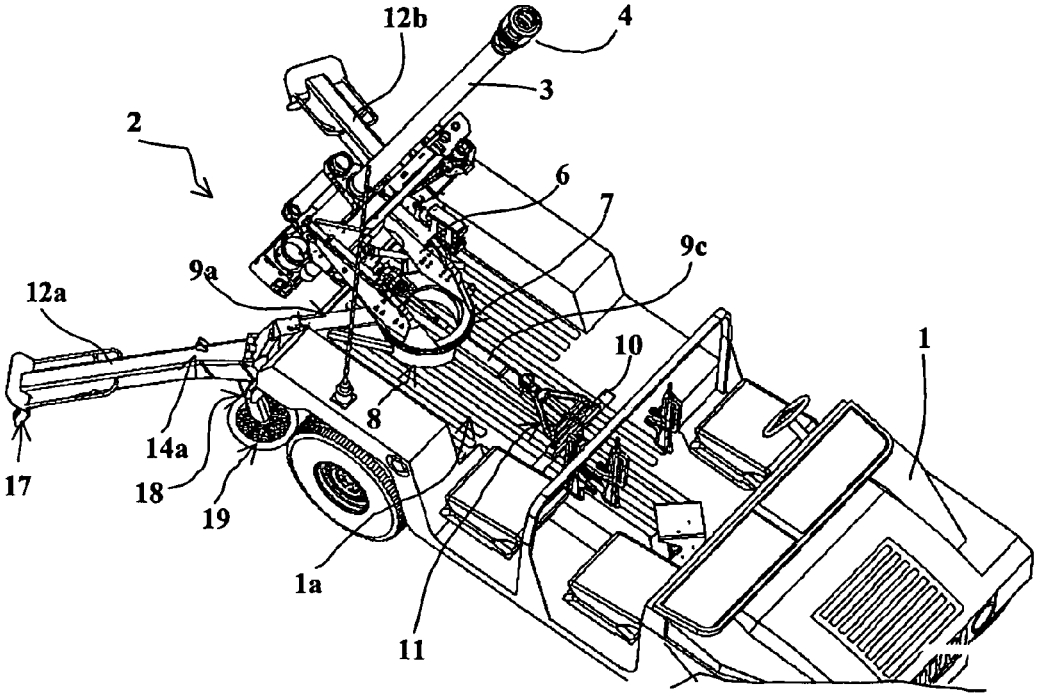
Figure 3B:
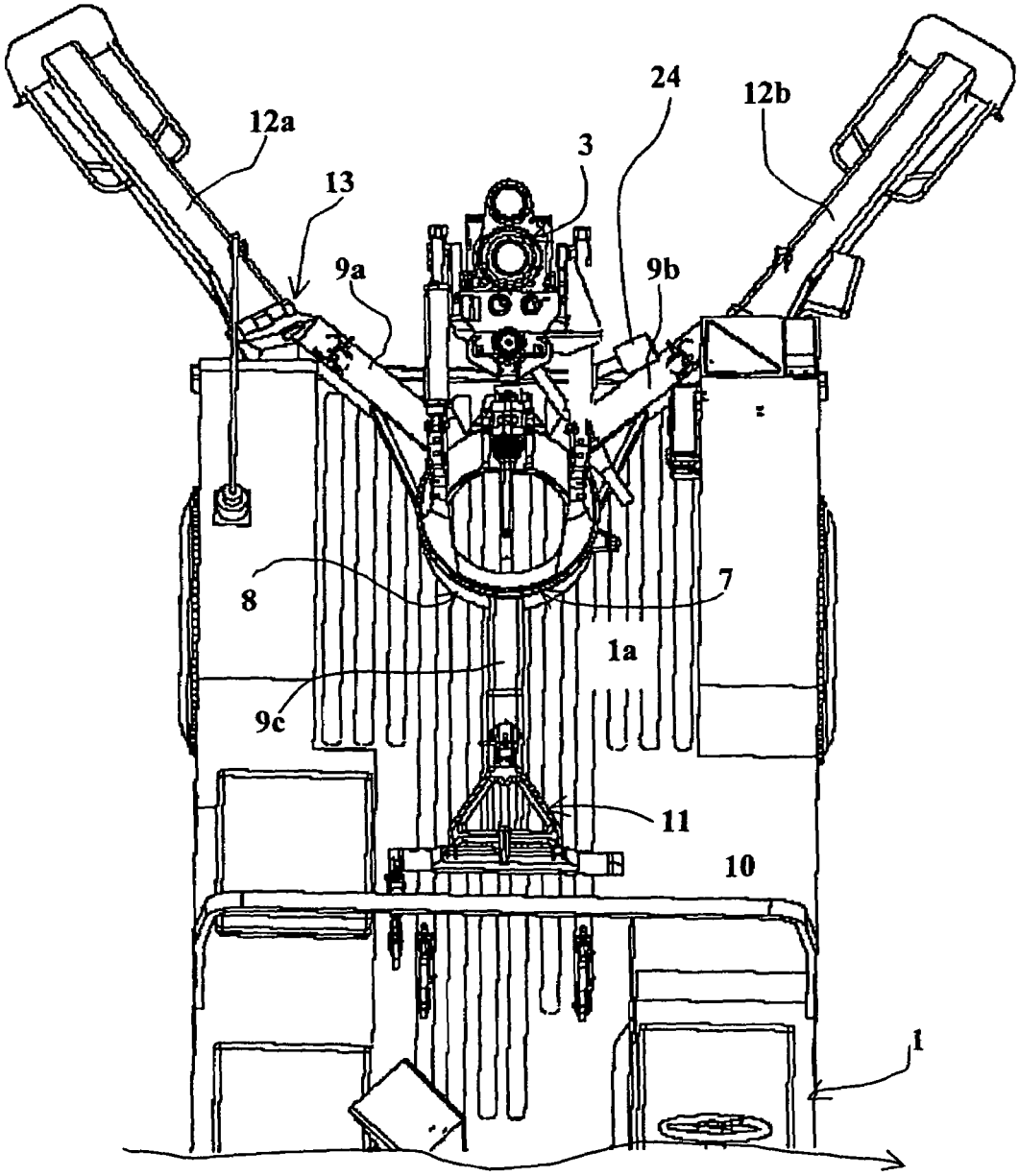
Figure 3C:
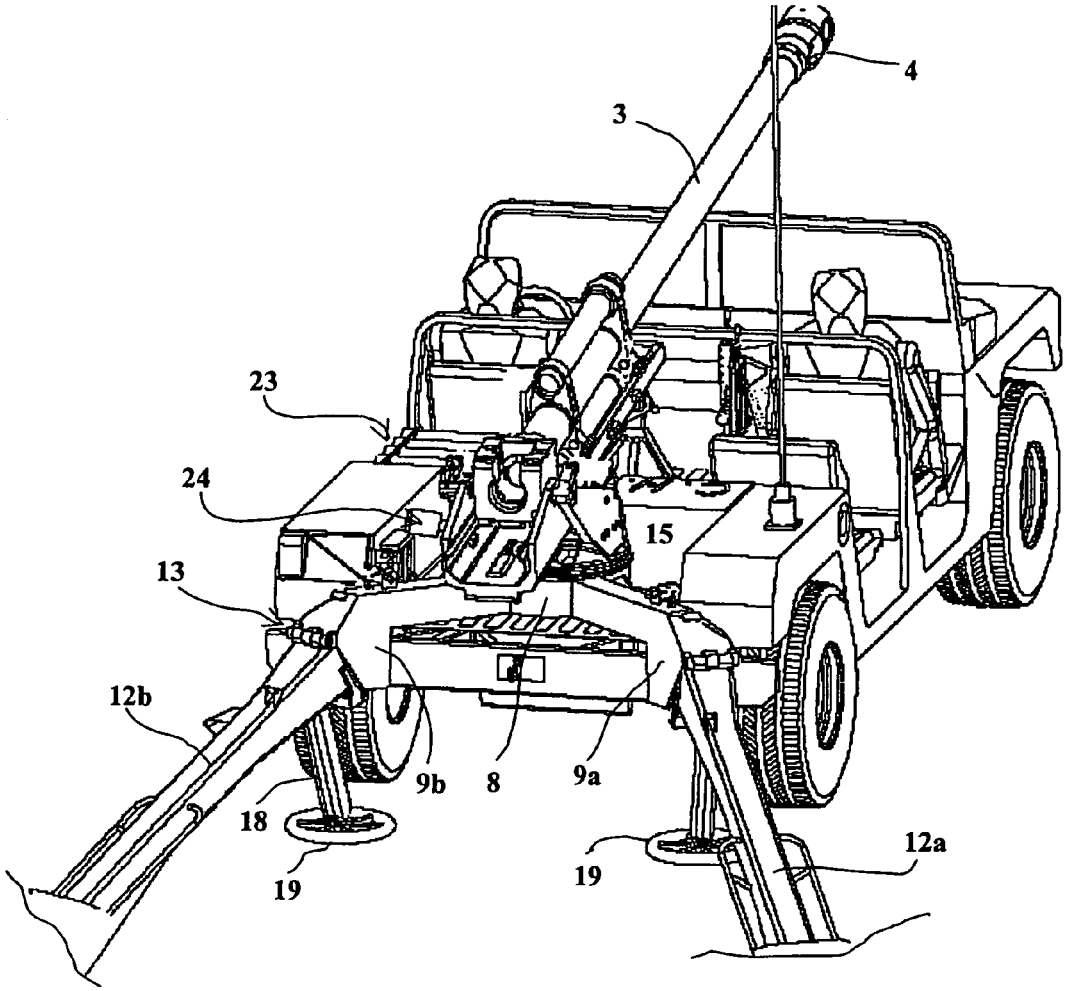
Figure 4:
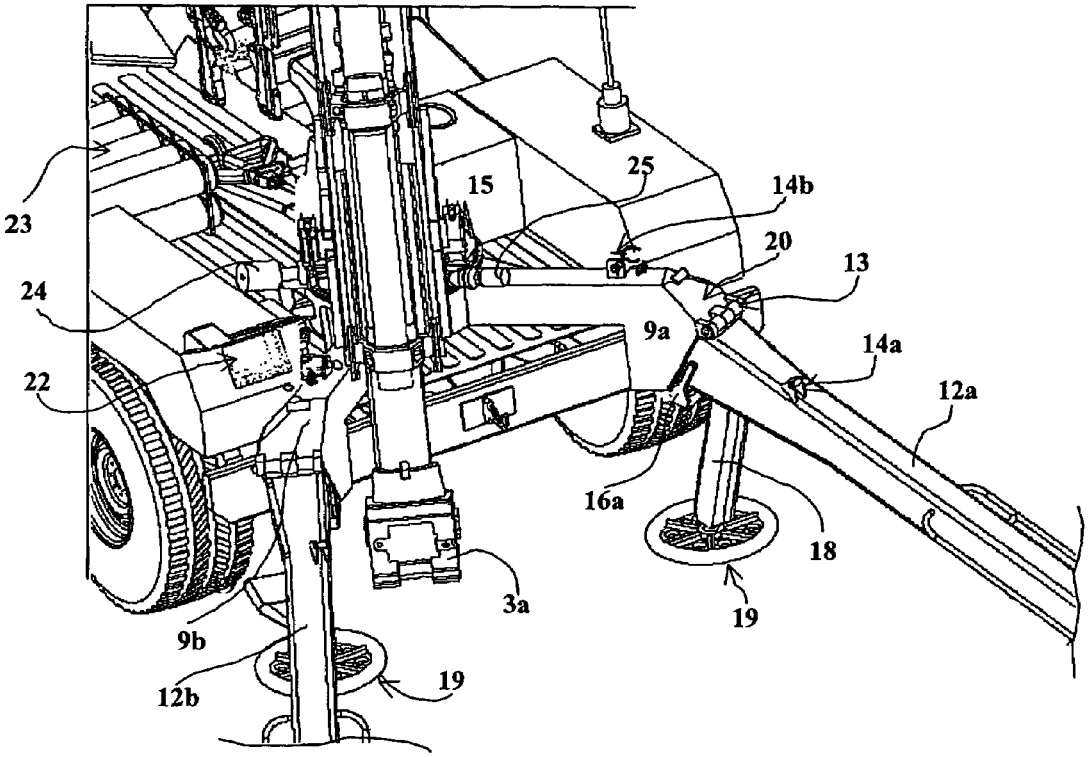
FIG. 4 is a partial detailed view showing the articulation of the arm and its locking means.

The cradle is classically made to pivot with respect to the fork by an electric motor 24 (see FIGS. 3*c* and 4).

The fork 6 is, furthermore, mounted on a turntable 7 (for example with ball bearings) which can be seen more particularly in FIGS. 3*a* and 3*b* and which enables the fork to rotate around a vertical shaft to enable the weapon to be laid in traverse. The fork is made to rotate (traverse laying) on the turntable by means of another electric motor 25 (see FIG. 4).

The laying motors 24 and 25 are powered by an electric generator, not shown. A hydraulic generator may also be implemented that associates hydraulic motors or jacks.

The turntable receiving the fork is integral with a base 8 fastened to a rear part of the vehicle 1.

The base 8 may be more particularly seen in FIGS. 3*a* and 3*b*. It incorporates a substantially circular central part onto which the turntable 7 is fastened and which is extended by three arms 9*a*, 9*b* and 9*c* evenly spaced angularly around the central part.

One front branch 9*c* is fastened to the chassis of the vehicle 1 by a bracket 10 bolted or welded to the chassis through the floor 1*a*. This bracket moreover has a hinged lashing hook 11 allowing the barrel 3 to be held in place with respect to the vehicle 1 when the vehicle is moving.

The rear branches 9*a* and 9*b* are also fastened to the vehicle chassis by means that are not visible in the Figures (for example, bolts).

The rear branches 9*a* and 9*b* have arms 12*a* and 12*b* which are hinged onto the branches by pins 13 (see FIGS. 1 and 4). The arms may pivot with respect to the branches by means of hydraulic jacks, not shown in order not to encumber the Figure, but which will be mounted between a first lug 14*a* welded to the arm 12*a* or 12*b* and a second lug 14*b* welded to the branch 9*a* or 9*b* (see FIG. 4).

These jacks will be supplied with pressurised fluid by a hydraulic generator 15 fixed to the floor 1*a* (see FIGS. 3*c* and 4).

Locking means 16 are provided on each arm to ensure the immobilization of the arms 12*a* and 12*b* in their deployed position. These locking means are shown open in FIG. 1. They incorporate a prong 16*a* fixed to the end of each branch 9*a*, 9*b*, such prong intended to cooperate with fingers 16*b* carried on each arm 12*a*, 12*b*. Prong 16*a* is mounted able to tip over with respect to the branch 9*a*, 9*b* in question and is held in a position in which it engages the fingers 16*b* by spring means (not shown).

Each arm 12*a*, 12*b* is extended by a spade 17 intended to anchor the arms in the ground and is also fitted with a safety support 18 intended to press on the ground, such support being positioned between the spade 17 and the point of articulation 13 of the arm 12*a*, 12*b* in question on its branch 9*a*, 9*b*.

Each safety support 18 is rigidly connected to the arm 12*a*, 12*b* in question. It may, for example, be fastened to the arm by welding. The arms 12*a*, 12*b* and branches 9*a*, 9*b* of the base as well as the safety supports 18 are made of mechanically welded plate metal.

Each support 18 has a plate 19 at its foot intended to press on the ground. This plate is intended to supply a bearing surface with the ground that is enough to guarantee the stability of the weapon system even on loose ground.

The plate 19 is linked to the support by a joint which gives it at least three degrees of freedom in rotation with respect to the support (ball and socket type joint), this in order to ensure bearing despite any irregularities of the ground. Such a ball and socket joint is well known to the Expert and is commercially available. It is thus unnecessary for it to be described in detail.

When arms 12*a* and 12*b* are in their folded position (FIG. 1), their upper faces abut against a plane zone 20 on the corresponding branch 9*a*, 9*b* (see FIG. 4).

When arms 12*a* and 12*b* are in their extended position (FIG. 2*a*) and the vehicle is on horizontal ground, the safety support 18 is substantially vertical and the spade 17 is at a distance D from the ground of between 0 mm and 200 mm.

Note that in this case the lock 16 is not yet locked.

For the weapon system to be able to fire, it is necessary for the spades 17 to be pushed into the ground. Indeed, in this case the weapon system is in contact with the ground by a bearing polygon of sufficient size which namely prevents the excessive lifting of the vehicle 1 to the rear under the effect of the cannon 3 recoil.

For the spades to be able to be pushed into the ground, the following procedure is adopted.

After the arms 12*a*, 12*b* have been extended rearwards of the vehicle until the safety support 18 rests on the ground, the vehicle 1 is made to reverse under its own motorization.

Each support 18 is rigid with respect to the arm 12*a*, 12*b* in question so that the recoiling vehicle causes the arms 12*a*, 12*b* to pivot on the ends of the supports 18 thanks to the plates 19.

The spades 17 are thus pushed into the ground and the rear axle 21 of the vehicle 1 lifts up slightly off the ground.

At the same time, this pivoting of the arms results in ensuring the locking of locks 16 ensuring in turn the rigidity of the arm 12*a*, 12*b* and branch 9*a*, 9*b* assembly integral with the base 8.

Figure 5A:
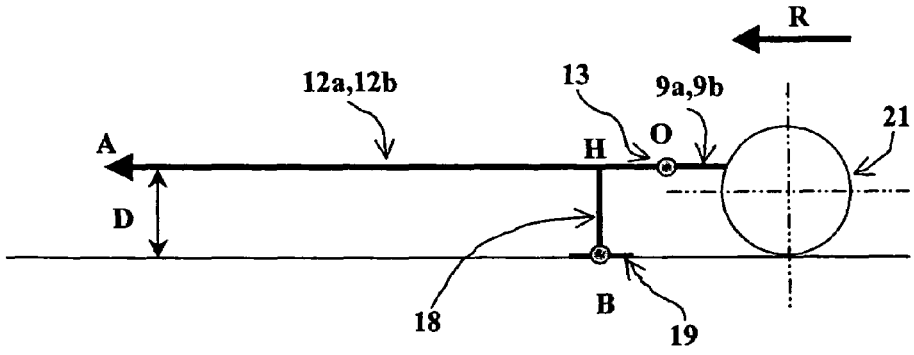
FIGS. 5*a* and 5*b* are explanatory schemas showing the kinematics of the arms.
Figure 5B:
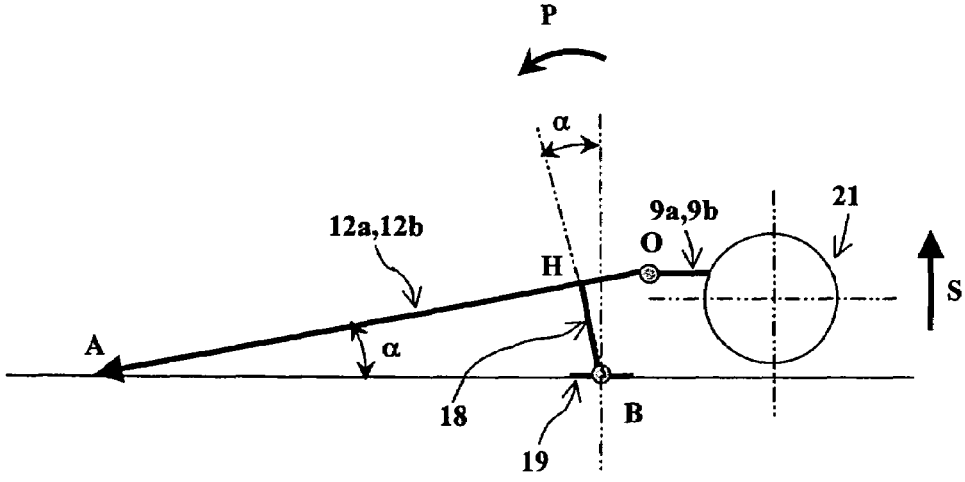

The schemas shown in FIGS. 5*a* and 5*b* help the implementation of the invention to be better understood.

Point H represents the link between a support 18 and an arm 12*a*, 12*b*. Point O represents the joint 13 of the arm 12*a*, 12*b* in question and its branch 9*a*, 9*b*.

Point A represents the end of the spade 17 pushed into the ground.

Point B represents the ball joint connecting the end of the support 18 and the plate 19 in contact with the ground.

A circle schematizes a wheel on the rear axle 21 which, naturally, is integral with the branches 9*a*, 9*b* fixed to the vehicle floor.

FIG. 5*a* shows one of the arms 12*a*, 12*b* when it has been extended, support 18 pressing on the ground.

The vehicle 1 is made to reverse (movement in direction R). The device thus takes up the configuration shown in FIG. 5*b*. The arms 12*a*, 12*b* and support 18 form a rigid system, the only freedom of the device is, in fact, a pivoting of angle $\alpha$ around the ball joint B, thereby causing the rear axle 21 to lift up slightly (slight lift which is emphasized in the Figure to help clarify the explanation).

The end A (spade 17) pushes in the ground and the arm forms an angle $\alpha$ with the horizontal.

Since the rear axle 21 is no longer in contact with the ground, most of the recoil stresses are taken up by the arms 12*a*, 12*b* and their supports 18.

Someone skilled in the art will easily determine the arms and supports according to the characteristics of the vehicle.

An arm length OA will be selected in particular which ensures (for a given vehicle mass) a sufficient lever arm at the rear of the vehicle to prevent it from rolling over during firing. According to the characteristics of the weapon, it is possible for the device according to the invention to be supplemented by means also enabling the elevation of the cannon to be reduced during firing.

Means may be provided at the muzzle brake 4 enabling a torque to be exerted during firing that causes the weapon system 2 to pivot around point A in a direction allowing the support 18 to be more strongly pressed on the ground. These means may be constituted quite simply by one or several drill holes 22 (FIG. 1) positioned on the upper surface of the muzzle brake 4. These drill holes will enable the evacuation during firing of part of the propellant gases in a vertical direction oriented upwards.

The muzzle brake may thus be given an asymmetric shape (for example at its vents 23), such shape ensuring the appearance of stresses making the weapon system pivot in the required direction. For example, it is possible to provide the inside of the brake with a surface onto which the gas pressure is exerted which is greater under rather than over a median plane of the muzzle brake.

Such arrangements related to the muzzle brake do not form the subject of the present invention but are more particularly described in application FR-04.10903 dated 14 Oct. 2004 to which reference may be made.

A low value for angle α enables the amplitude of the rear pivoting to be reduced. This amplitude is also reduced by selecting a distance D between the spade 17 and the ground that is fairly reduced when the arm has just been extended. For a weapon system of a caliber of between 90 mm and 105 mm an angle α will preferably be selected of between 10° and 30° and a distance D will be adopted between the spade and the ground (horizontal) which will be of between 0 mm and 200 mm. The full length of the arms is between 1 and 2 m.

The lifting amplitude of the axle 21 also depends on the distance OH between the joint 13 and the safety support 18.

A distance OH will be chosen, for example, that is between 5% and 20% of the full length of the safety support.

It can be seen that, thanks to the invention, it is possible to provide a link to the ground for a weapon system using relatively simple light means and enabling firing from a relatively light vehicle.

The device according to the invention is also very rapidly implemented, since the vehicle 1 itself is used to ensure anchorage to the ground.

On the contrary, to withdraw the weapon system according to the invention, the arms have firstly to be unlocked (by manual action on the prong 16*a* which, to this end, is fitted with a handgrip—see FIG. 4).

The, the vehicle 1 merely has to be driven forwards. Such an operation ensures the contrary pivoting of the arms 12 and enables the spades to be pulled from the ground.

The arms 12*a*, 12*b* are then folded to the front of the vehicle by means of their hydraulic jacks.

In practical terms, the deployment of the weapon system is made is less than 30 seconds. The time required to withdraw the system is roughly the same. When the weapon system is in the firing position (FIG. 2*c*) is it naturally possible for its positioning in elevation and in traverse to be controlled from a control console 22 (see FIG. 4).

Pivoting in elevation and in traverse is ensured by electric motors 24 and 25. The pivoting amplitude in traverse is of around 100°; the pivoting amplitude in elevation is of between −10° and +70° with respect to a horizontal plane via trunnions 3*c*.

Electronic means (not shown) allow firing control. These means are classical and comprise: a firing computer incorporating ballistic data, a global positioning system (GPS) supplemented by an inertial unit and means to communicate with a command post. These means are coupled with the electric motors and enable the rapid laying of the cannon so as to ensure the firing required by the command post.

Naturally, the vehicle may carry a stock of ammunition which will be placed in a rack 23 (see FIGS. 3*c* and 4, the rack not being visible in the other Figures). A trailer may also be provided to carry other ammunition.

What is claimed is:

1. A weapon system incorporating a cannon mounted on a cradle integral with a vehicle, wherein said cradle is integral with a base fastened at the rear part of said vehicle, said base on which at least two arms are hinged each carrying a spade at their ends, each of said arms able to be locked into its extended position and also incorporating a safety support intended to press on the ground between said spade and said base, so that when each of said arms is in the extended position and when said vehicle is on substantially horizontal ground, said safety support is substantially vertical, and the end of each spade is at a distance from the ground of between 0 mm and 200 mm.

2. A weapon system according to claim 1, wherein said safety support has a plate at its foot for pressing the ground, such said plate being hinged to said support.

3. A weapon system according to claim 1, wherein the distance between said safety support and an articulation point of said arm on said base is between 5% and 20% of the full length of said support.

4. A weapon system according to claim 3, wherein said base incorporates at least two branches onto which said arms are hinged, with locking means located between each branch and the articulated arm that it carries.

5. A weapon system according to claim 4, wherein said locking means are in the locking position when said arm is inclined with respect to the horizontal by an angle (α) of between 10° and 30°.

6. A weapon system according to claim 5, wherein said base carries a turntable onto which a fork carrying said cradle is fastened.

7. A weapon system according to claim 5, wherein said cradle is pivotable in elevation and in traverse with respect to said base by motor means.

8. A weapon system according to claim 1, wherein said arms are pivotable by hydraulic jacks powered by a generator integral with said vehicle.

9. A weapon system according to claim 1, wherein said cannon is 155 mm caliber and the pivoting capacity of said cradle in traverse is around 100°.

10. A weapon system according to claim 8, wherein the pivoting capacity in elevation is of between −10° and +70°.

11. A process for implementing a weapon system according to claim 1, wherein to set up said weapon system, the following steps are carried out successively:

said arms are extended rearwards of said vehicle until said safety supports come to rest on the ground, said vehicle is driven rearward to make said arms pivot on the ends of said safety supports thereby pushing said spades into the ground.

12. The process according to claim 11, wherein to withdraw said weapon system, the following additional steps are carried out successively:

said arms are unlocked, said vehicle is driven forward to pull said spades from the ground, said arms are folded to the front of said vehicle.

* * * * *